US005588551A

United States Patent [19]

Morrow et al.

[11] Patent Number: 5,588,551

[45] Date of Patent: Dec. 31, 1996

[54] EATING AID

[76] Inventors: Megan J. Morrow; Dennis Morrow, both of P.O. Box 123, Wilmington, Vt. 05363

[21] Appl. No.: 647,654

[22] Filed: May 15, 1996

[51] Int. Cl.[6] ..... A47G 19/02

[52] U.S. Cl. ..... 220/574.1; 220/608; 220/511

[58] Field of Search ..... 220/574.1, 608, 220/511, 729, 737, 574

[56] References Cited

U.S. PATENT DOCUMENTS 2,940,634 6/1960 Wild .
2,974,820 3/1961 Romei .
3,422,986 1/1969 Tilseth .
5,172,826 12/1990 Celaya .
5,390,816 2/1995 Boyd .

*Primary Examiner*—Joseph M. Moy
*Attorney, Agent, or Firm*—Sprung Horn Kramer & Woods

[57] ABSTRACT

An eating aid comprises a one-piece, integral, elastically deformable member having a top wall and a continuous side wall with a bottom edge surrounding a depression. The member cooperates with a substantially smooth and planar surface to form a closed chamber when the bottom edge is disposed thereon and adheres to the surface by suction in response to a downward deformation of the top wall. The side wall extends upwardly from the surface when the member is adhered thereto to form an inwardly arcuate abutment surface with an overhanging lip configured to force food pushed against the abutment surface by an eating utensil onto the utensil when a user is eating food off of the planar surface.

8 Claims, 2 Drawing Sheets

EATING AID

BACKGROUND OF THE INVENTION

The present invention relates to an eating aid, and more specifically, to a device for aiding persons to eat when they only have the use of one hand.

Eating aid devices are known in the prior art, but these devices have the disadvantage of being permanently mounted to dishes and thus not portable, difficult or complicated to make and/or use, or not easily washed for repeated use.

SUMMARY OF THE INVENTION

The main object of the present invention is to eliminate the disadvantages of prior art devices.

Another object of the present invention is to provide an eating aid which is a stop against which a person can push food with an eating utensil, thereby making it easier to get the food onto the utensil without the need to use a second utensil in a second hand.

A further object of the present invention is to provide an eating aid which is particularly useful for persons handicapped by the loss or the loss of use of one arm, including amputees, stroke victims and hospital patients connected to intravenous tubes. Other users can include young children and non-handicapped adults who simply prefer eating while keeping one hand free to do something else, such as reading a book.

A still further object of the present invention is to provide an eating aid which can be molded out of flexible, dishwasher-safe material, such as plastic, and shaped in a manner so as to adhere to a top surface of a plate by suction and which can be adhered simply by placing the device on the top surface of the plate and pressing firmly at the center of the device.

These and other objects of the present invention are achieved in accordance with the present invention by an eating aid which comprises a one-piece, integral, elastically deformable member having a top wall and a continuous side wall with a bottom edge. The side wall surrounds a depression and the member cooperates with a substantially smooth and planar surface to form a closed chamber when the bottom edge is disposed thereon and adheres to that surface by suction in response to a downward deformation of the top wall. The side wall extends upwardly from the surface when the member is adhered thereto to form an abutment surface with an overhanging lip configured to force food onto an eating utensil pushed against the abutment surface by the eating utensil. Because of the preferable snowplow-like shape of the abutment surface, food is forced onto the utensil when a user is eating food off of the planar surface. The abutment surface is preferably inwardly arcuate from the lip to the bottom edge.

The eating aid can be composed of rubber and is preferably composed of plastic, such as PVC or TPE. The eating aid preferably has a plurality of sides, most preferably three. In a particularly preferred embodiment, the member has a substantially triangular shape.

In a particularly advantageous embodiment of the present invention, at least one side of the member has a straight edge to accommodate an edge of a fork and has a length approximately equal to the standard length of the tines of a fork, about 2". At least one other side of the member has an arcuate shape to accommodate and edge of a spoon and has a length approximately equal to that of the edge of a spoon, approximately 2". The height is preferably ¼" to 1", most preferably ⅝".

These and other features and advantages of the present invention will be seen from the following detailed description of the invention, taken with the attached drawings, wherein:

DETAILED DESCRIPTION OF THE INVENTION

Figure 1:
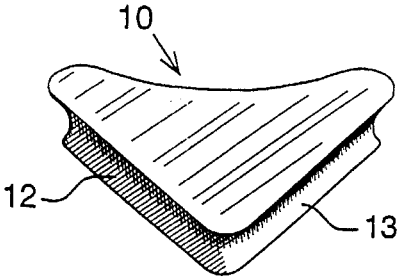
FIG. 1 is a top perspective view of the eating aid according to the present invention.
Figure 2:
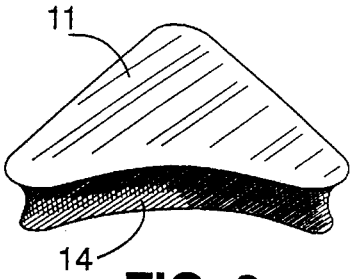
FIG. 2 is a rear perspective view of the device of FIG. 1.
Figure 3:
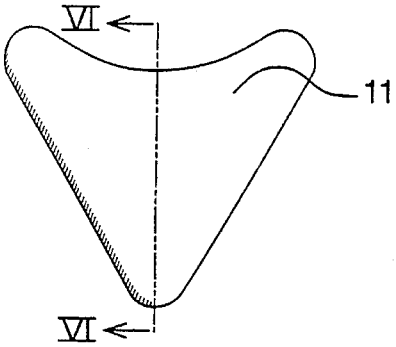
FIG. 3 is a top view of the device of FIG. 1.
Figure 4:
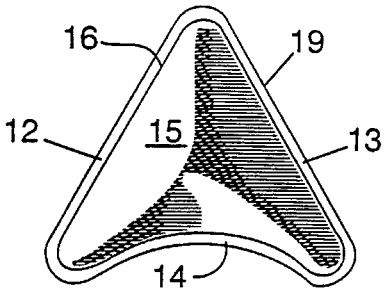
FIG. 4 is a bottom view of the device of FIG. 1.
Figure 5:
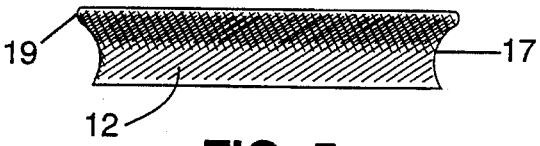
FIG. 5 is a side view of the device of FIG. 1.

Referring now to FIGS. 1–6, the eating aid 10 according to the present invention is disclosed.

As shown, the eating aid 10 is a one-piece integral, elastically deformable member having a top wall 11 and a continuous side wall having sides 12, 13 and 14. The side wall also has a continuous bottom edge 16. The continuous side wall surrounds a depression 15.

The continuous side wall has an inwardly arcuate surface outline 17 terminating in an overhanging lip 19 which is designed to have the shape similar to that of a snowplow. The use of the shape will be described hereinafter.

Figure 6:
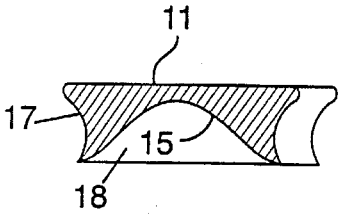
FIG. 6 is a sectional view along line VI—VI in FIG. 3.

The depression 15 defines an open area 18 shown in FIG. 6. As a result of the configuration of the member as described and the fact that it is elastically deformable, the member is able to adhere to a substantially smooth and planar surface, such as a plate or a dish as will be described.

Figure 7:
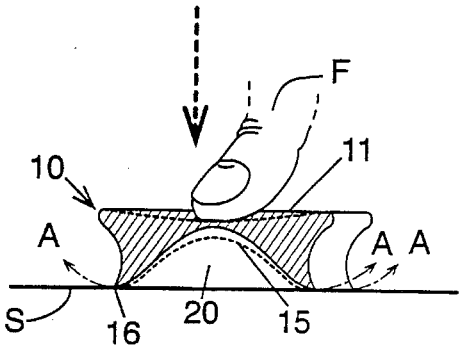
FIG. 7 shows the operation of the device in accordance with the present invention.

Referring now to FIG. 7, when the member 10 is placed on a surface S, the bottom edge 16 cooperates with the surface S to form a closed chamber 20 demarcated by depression 15 and surface S. When the user's finger F is used to downwardly deform the top surface 11 as shown, the sides of the member are also deformed to some extent. Air is evacuated as shown by arrows A and a suction force is created when finger F is removed. This suction force adheres the member 10 to the surface S for use as an eating aid.

Figure 8:
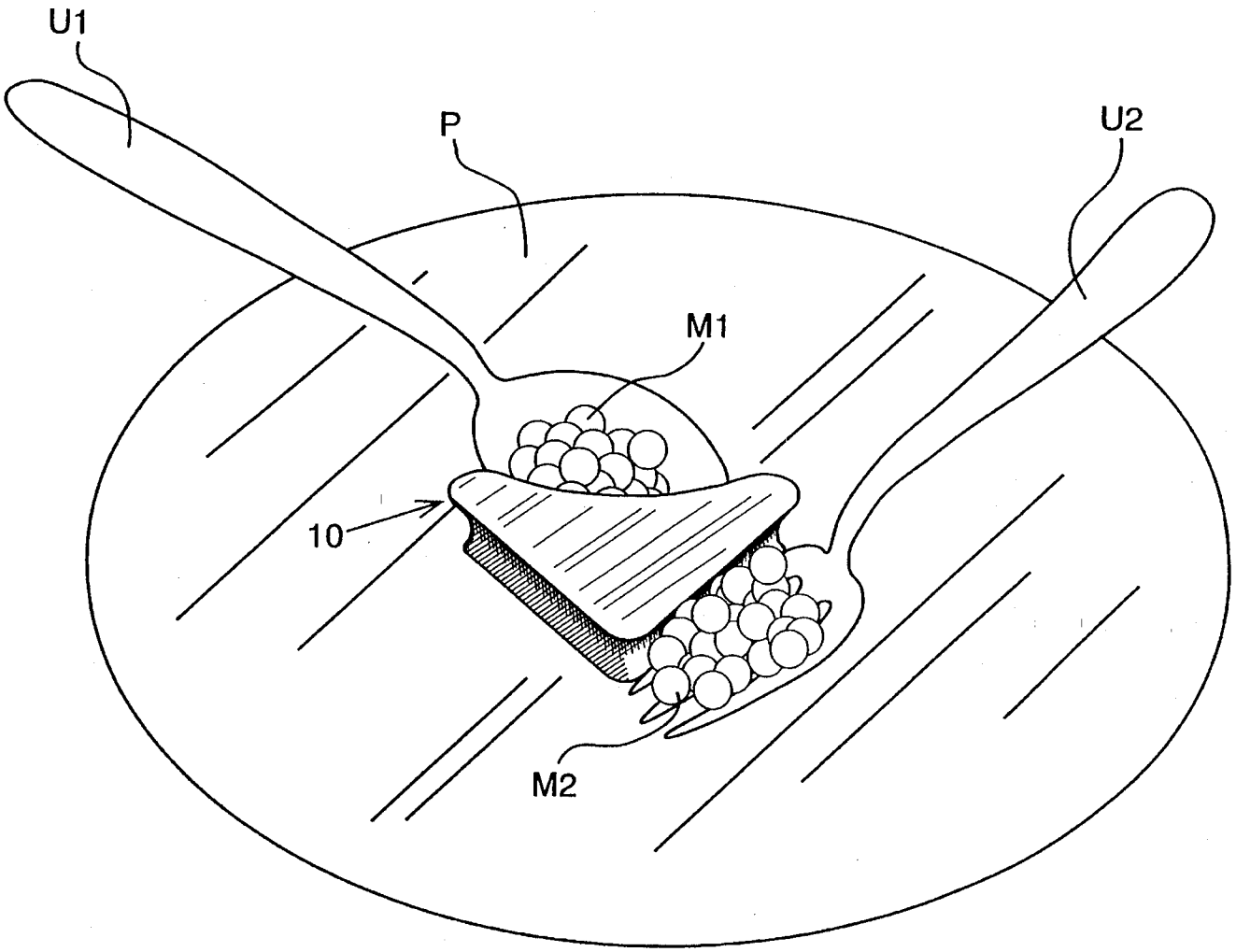
FIG. 8 shows the device according to the present invention in use.

As can be seen in FIG. 8, the eating aid 10 is adhered to a plate P. Two of the sides 12 and 13 of the member are substantially straight and have a length substantially equal to the length of the tines on the fork U2 about 1½ to 2".

The side 14 is inwardly arcuate to accommodate the edge of a spoon U1 and has a length substantially equal to the length of the edge of a spoon about 1½ to 2". The height of the member 10 is ¼" to 1", preferably ⅝.

Both the straight sides 12 and 13 and the arcuate side 14 have the snowplow-like surface outline 17. Thus when food M1 or M2 is forced against the abutment or stop surfaces of sides 12–14 by utensils U1 and U2 respectively, the shape of the surface forces the food back towards the utensil and the lip 19 insures that it is not pushed onto the top surface 11 of the eating aid 10.

After use, the suction seal is broken, and the member is removed from the plate. It can then be washed by hand or in a dishwasher.

The member 10 is composed of rubber or preferably made of soft polyvinylchloride or thermoplastic elastomer and having a Shore hardness of less than about 65. The member is preferably formed by molding rubber or injection molding the plastic to form the integral one-piece member as shown.

It is understood by those of ordinary skill that other types of plastic and other suitable materials may be selected for the invention and that other techniques for forming such members can be used.

It should also be apparent that the size of the member can be changed to make it bigger or smaller, depending upon the size of the utensils used and the available area on a dish or plate. It is clear that the abutment surface can be formed from a series of straight sections. Moreover, it should be recognized that although a triangular shape is shown, the eating aid can be in the shape of other types of polygons or irregular polygons without departing from the scope or intent of the present invention.

It is understood that the embodiments described hereinabove are merely illustrative and are not intended to limit the scope of the invention. It is realized that various changes, alterations, rearrangements and modifications can be made by those skilled in the art without substantially departing from the spirit and scope of the present invention.

What is claimed is:

1. An eating aid comprising: a one-piece, integral, elastically deformable member having a top wall and a continuous side wall with a bottom edge surrounding a depression, wherein the member cooperates with a substantially smooth and planar surface to form a closed chamber when the bottom edge is disposed thereon and adheres to the surface by suction in response to a downward deformation of the top wall and wherein the side wall extends upwardly from the surface when the member is adhered thereto to form an abutment surface with an overhanging lip configured to force food pushed against the abutment surface by an eating utensil onto the utensil when a user is eating food off of the planar surface.

2. The eating aid according to claim 1, wherein the member is composed of plastic.

3. The eating aid according to claim 1, wherein the member is composed of rubber.

4. The eating aid according to claim 1, wherein the member has a plurality of sides.

5. The eating aid according to claim 4, wherein the member is substantially triangular.

6. The eating aid according to claim 4, wherein at least one side is arcuate to accommodate an edge of a spoon.

7. The eating aid according to claim 4, wherein at least one side is straight to accommodate an edge of a fork.

8. The eating aid according to claim 1, wherein the abutment surface is inwardly arcuate between the lip and bottom edge.

* * * * *